US009249943B2

(12) United States Patent
Hossfeld et al.

(10) Patent No.: US 9,249,943 B2
(45) Date of Patent: Feb. 2, 2016

(54) LIGHT MODULE FOR A MOTOR VEHICLE HEADLAMP

(71) Applicant: Automotive Lighting Reutlingen GmbH, Reutlingen (DE)

(72) Inventors: Wolfgang Hossfeld, Gomaringen (DE); Christian Buchberger, Reutlingen (DE)

(73) Assignee: AUTOMOTIVE LIGHTING REUTLINGEN GMBH, Reutlingen (DE)

( * ) Notice: Subject to any disclaimer, the term of this patent is extended or adjusted under 35 U.S.C. 154(b) by 101 days.

(21) Appl. No.: 14/258,115

(22) Filed: Apr. 22, 2014

(65) Prior Publication Data

US 2014/0321143 A1 Oct. 30, 2014

(30) Foreign Application Priority Data

Apr. 29, 2013 (DE) ..... 10 2013 207 850

(51) Int. Cl.
*F21V 11/00* (2015.01)
*F21S 8/10* (2006.01)

(52) U.S. Cl.
CPC ..... *F21S 48/1283* (2013.01); *F21S 48/115* (2013.01); *F21S 48/1159* (2013.01); *F21S 48/1258* (2013.01); *F21S 48/137* (2013.01); *F21S 48/1329* (2013.01); *F21S 48/1388* (2013.01); *F21S 48/145* (2013.01); *F21S 48/1747* (2013.01)

(58) Field of Classification Search
CPC . F21S 48/1283; F21S 48/115; F21S 48/1159; F21S 48/137; F21S 48/145; F21S 48/1747; F21S 48/1258; F21S 48/1329; F21S 48/1388
USPC ..... 362/509, 545, 538, 539
See application file for complete search history.

(56) References Cited

U.S. PATENT DOCUMENTS

| | | | | |
|---|---|---|---|---|
| 6,736,533 | B2 * | 5/2004 | Matsumoto | F21S 48/1358 362/305 |
| 7,690,818 | B2 * | 4/2010 | Takada | B60Q 1/12 362/297 |
| 7,794,128 | B2 * | 9/2010 | Fujiwara | B60Q 1/0041 362/459 |
| 8,092,059 | B2 * | 1/2012 | Yamagata | F21S 48/1159 362/517 |

(Continued)

FOREIGN PATENT DOCUMENTS

| | | | |
|---|---|---|---|
| DE | 102008036192 | A1 | 2/2010 |
| DE | 102009020593 | A1 | 11/2010 |
| DE | 102011004569 | A1 | 8/2012 |

(Continued)

*Primary Examiner* — Ali Alavi
(74) *Attorney, Agent, or Firm* — Howard & Howard Attorneys PLLC

(57) ABSTRACT

The present invention is directed toward a light module for a motor vehicle headlamp having a primary lens which conducts light emitted by a light source to an intermediate light distribution, wherein an aperture shutter is disposed in relation to a secondary lens such that light in the intermediate light distribution, which passes by the aperture shutter on a first side of the aperture shutter, ends up in a first beam path in a region lying on a first side of the light/dark border in the second light distribution. The primary lens deflects a portion of the light emitted from the light source, such that it passes by the aperture shutter on a second side of the aperture shutter, and is distributed by the secondary lens in a second beam path in a region lying on a second side of the light/dark border in the second light distribution.

15 Claims, 4 Drawing Sheets

(56) References Cited

U.S. PATENT DOCUMENTS

| | | | | |
|---|---|---|---|---|
| 8,506,146 | B2 * | 8/2013 | Kinoshita | B60Q 1/076 362/516 |
| 2009/0303741 | A1 | 12/2009 | Shih | |

FOREIGN PATENT DOCUMENTS

| | | | |
|---|---|---|---|
| EP | 624753 | A2 | 11/1994 |
| EP | 1464890 | A1 | 10/2004 |
| EP | 1980787 | A1 | 10/2008 |

* cited by examiner

LIGHT MODULE FOR A MOTOR VEHICLE HEADLAMP

CROSS-REFERENCE TO RELATED APPLICATION

This application is based upon and claims priority to German Patent Application 10 2013 207 850.1 filed on Apr. 29, 2013.

BACKGROUND OF THE INVENTION

1. Field of Invention

The present invention relates to a light module for a motor vehicle headlamp.

2. Description of Related Art

Light modules are known in the art. For example, published German Patent DE 10 2008 036 192 discloses at least one first light source, a primary lens, an aperture shutter and a secondary lens. The primary lens is configured to convey light emitted from the light source to an intermediate light distribution lying between the primary lens and the secondary lens. The aperture shutter has a coherent outer edge and an aperture shutter surface, which extends into the intermediate light distribution, and which is bordered by an aperture shutter edge. The aperture shutter is disposed in relation to the secondary lens such that the aperture shutter edge is projected by the secondary lens as a light/dark border in a second light distribution, which is generated as an image of the intermediate light distribution by the secondary lens in a foreground of the light module. The primary lens is disposed in relation to the secondary lens such that the secondary lens distributes light in the intermediate light distribution, which passes by the aperture shutter on one first side of the aperture shutter in a first beam path, in a region lying on one first side of the light/dark border in the second light distribution.

A module of this type generates a light distribution having light/dark borders, such as, for example, a low beam or fog lights. Depending on the design, a light module of this type having at least one further light source and one further primary lens as well, is also suited for generating a high beam light distribution using the same secondary lens.

Light modules of this type are also known as projection systems. They include one or more LEDs as the light source, having associated focusing lenses as the primary lens, a horizontal aperture shutter, and a projection lens as the secondary lens. A light module is known from DE 10 2011 004 569 A1, which uses a reflector as the secondary lens. The invention can also be used with light modules of this type. A light/dark border is generated by the aperture shutter, so as to avoid blinding oncoming vehicles.

One disadvantage of projection systems known in the art is that only a small amount of light ends up in the region above the light/dark border, such that objects (for example, traffic signs) are not sufficiently lit. In order to not blind oncoming vehicles and to ensure a sufficient recognition of objects in this dark region, there are government-mandated regulations that require light intensities between 64 and 625 cd in a region of typically 2 to 4 degrees in the vertical direction and −8 to 8 degrees in the horizontal direction. This region is frequently referred to as the "overhead" region. The degree specifications for the vertical direction relate thereby to upward deviations from a longitudinal direction of the motor vehicle. The degree specifications for the horizontal direction relate to deviations to the right and left from the longitudinal direction. The vertex of the angle is located in the light module thereby. In order to obtain these light intensities in the overhead region, the use of a lens which exhibits structures that deflect light into the overhead region as the secondary lens, is known from EP 1 980 787. A similar solution is described in EP 464 890. However, in each case, the structures are disadvantageously outwardly visible to an observer of the headlamp, which has a negative effect on the appearance of the headlamp. In particular, at night, the regions of the lens that diffuse the light are visible to the observer as bright points, lines, or areas, and are thus disadvantageous in terms of the appearance of the headlamp.

With the subject matter known from DE 10 2009 020 593, light is deflected to the overhead region with numerous small prism structures on a lens. This solution also has the disadvantage that the small prism structures are visible to the observer of the module. The micro-prisms deflect light in a preferred spatial direction, but the micro-prisms act as diffusion structures at their edges, which, in actual components, have a rounding that scatters light in a large spatial angular region. As a result, the small prisms appear as bright, in contrast to the rest of the surface of the lens, when viewing the lens from a region lying above the light/dark border of the light distribution generated by the module. This is typically the case when viewing an automobile from the front, the headlamps of which use projection lenses provided with prism structures of this type as secondary lenses. This appearance is frequently undesired.

In U.S. Pat. No. 6,736,533 and in EP 624 753, in each case, a solution is described wherein light is deflected above the light/dark border with an additional reflecting aperture plate lying between the aperture shutter edge of a first aperture shutter and the secondary lens in the beam path. The disadvantage with this solution is that it cannot be used with a light module that is a combination of a low beam light module and a high beam light module and having a horizontal aperture shutter (see EP 1 980 787). This is because the beam path necessary for the high beam function is a least partially blocked by the additional aperture shutter plate.

A solution is described in US 2009/0303741, in which the light is deflected into the overhead region with an optical fiber disposed between the aperture shutter and the secondary lens. The disadvantage with this solution is that with the optical fiber, at least one additional lens component is needed, which leads to higher costs.

SUMMARY OF THE INVENTION

The present invention concerns a light module that generates an overhead light distribution conforming to government regulations, in addition to a low beam light distribution conforming to government regulations, without the need for additional components, and without a negative effect on the outward appearance of the module. In addition, the light module also enables the generation of a high beam distribution. Objects such as those known from U.S. Pat. No. 6,736,533 or EP 624 753, for example, are excluded thereby, because they block the beam path necessary for the high beams, and normally require an additional component.

The present invention overcomes the disadvantages in the related art in a light module for a motor vehicle headlamp having at least one first light source, one primary lens, one aperture shutter and one secondary lens. The primary lens is configured to transmit light emitted from the light source to an intermediate light distribution lying between the primary lens and the secondary lens. The aperture shutter has a coherent outer edge and a shuttering surface, which extends into the intermediate light distribution, and is bordered by an aperture shutter edge. The aperture shutter is disposed in relation to the secondary lens such that the aperture shutter edge is projected as a light/dark border by the secondary lens in a second light distribution, which is generated by the secondary lens in a foreground of the light module as an image of the intermediate light distribution. The primary lens is disposed in relation to the secondary lens such that the secondary lens distributes light from the intermediate light distribution, which passes by the aperture shutter on a first side of the aperture shutter, in a first beam path, in a region lying on a first side of the light/dark border in the second light distribution. Further, the primary lens is configured to deflect a portion of the light emitted from the light source such that it ends up on a second side of the aperture shutter, passing by the aperture shutter on the outside, and is distributed by the secondary lens in a second beam path in a region lying on a second side of the light/dark border in the second light distribution.

The present invention differs from the prior art in that the primary lens is configured for deflecting a portion of the light emitted from the light source such that it ends up on a second side of the aperture shutter and passes by the aperture shutter on the outside, and is distributed by the secondary lens in a second beam path in a region lying on a second side of the light/dark border in the second light distribution. Thus, the light that is at least contributing to the overhead lighting passes by the aperture shutter, in particular, outside of the coherent outer edge of the aperture shutter. Alternatively, the primary lens is disposed in relation to the secondary lens such that the secondary lens distributes light from the intermediate light distribution in a first beam path, which passes by the aperture shutter on an upper side of the aperture shutter, to a region lying beneath the light/dark border in the second light distribution, wherein the primary lens is configured in order to deflect a portion of the light emitted from the light source, such that is passes by the aperture shutter in a region lying beneath the aperture shutter, and is distributed by the secondary lens in a second beam path, in a region lying above the light/dark border in the second light distribution.

With an intended use of the light module in a motor vehicle, at least a portion of the aperture shutter surface may be aligned substantially parallel to the horizon. In this case, the first side of the aperture shutter is an upper side. The first beam path runs above the aperture shutter surface as far as the aperture shutter edge. The region lying on the first side of the light/dark border in the second light distribution is the bright region of a low beam light distribution. In the second light distribution, the bright region lies below the light/dark border.

The second side of the aperture shutter is then a lower side of the aperture shutter. The second beam path runs, at least as far as the aperture shutter edge, beneath the aperture shutter surface and the region, which lies on the second side of the light/dark border in the second light distribution, thus lies above this light/dark border. This is the darker region of a low beam light distribution. The so-called overhead region lies in this darker region of the low beam light distribution.

A substantial element of the invention is that a portion of the light emitted from the light source, which is used for the low beam light, is directed by the primary lens below the aperture shutter such that it is distributed in the overhead region by the secondary lens. The preposition regarding the location relates thereby to an orientation of the light module in space in an intended use of the light module in a motor vehicle standing on a flat surface.

Advantages of the invention are that this solution can be used for both a pure low beam light module as well as for a combined low beam/high beam light module. It is also advantageous that this solution requires no additional components, and that it does not have a negative effect on the outward appearance of the module. The invention provides an overhead lighting that supplements a low beam light distribution, and serves, for example, for the illumination of signs. A particular advantage is that the invention enables the provision of the overhead lighting with a projection module, which uses semiconductor light sources with a primary lens and a mirror aperture shutter. The invention can be obtained by changes to the primary lens, and requires no changes to the secondary lens. The secondary lens thus remains unchanged thereby, and is illuminated such that it deflects light for the desired overhead lighting in the necessary direction. The invention can be used with light modules that use a projection lens as the secondary lens, as well as with light modules that use a reflector as the secondary lens. The aperture shutter may extend between the primary lens and the secondary lens in a fundamentally horizontal direction. The light source may be a semiconductor light source, in particular a light emitting diode, mounted on a mounting support or a printed circuit board. A first side of the aperture shutter may be created as a reflecting surface. Both sides of the aperture shutter may be created as reflecting surfaces.

In one embodiment, the primary lens has a light entry surface exhibiting numerous sub-surfaces, a light exit surface, and a light deflecting lateral surface. The light entry surface may have a central part and peripheral parts bordering the central part, wherein the light source and the different parts of the light entry surface would be disposed in relation to one another such that the light, when passing through the focusing lens, experiences different directional changes, which are caused by refraction and reflection. Furthermore, the light module may be designed such that light, the path of which runs on the first side of the aperture shutter, experiences a refraction upon entering the lens, which occurs via a peripheral part of the light entry surface, experiences a total reflection at a lateral surface, and experiences a refraction upon exiting the lens via the light exit surface. Further, the focusing lens may be designed such that light entering the light conducting material of the focusing lens via the central part of the light entry surface is allowed to pass to the light exit surface directly, without reflection on a lateral wall.

In one embodiment, the primary lens has a convexity in its lateral surfaces, wherein the convexity lies in a part of the lateral surface of the focusing lens facing the same side as the second side of the aperture shutter. Further, the convexity may be a single piece together with the rest of the primary lens, such that it protrudes as a projection from the lateral surface of the rest of the primary lens, and is bordered by a convexity lateral surface and a convexity light exit surface. Further still, the convexity may lay in a part of the lateral surface of the focusing lens that is closer to the light exit surface of the primary lens than to the light entry surface. Also, the convexity may have a light exit surface bordering on the rest of the light exit surface of the convexity, wherein the transition from the light exit surface to the rest of the light exit surface is without a crease.

In one embodiment, the convexity lateral surface and the convexity light exit surface are disposed, in relation to their orientation to the light form the light source striking the convex lateral surface, such that they direct at least a portion of this light along the aperture shutter, on the second side of the aperture shutter, to the secondary lens. Further, the convexity, and in particular its light exit surface, may be designed such that the overhead region of the light distribution is illuminated with the light emitted from the light exit surface. In another embodiment, the convexity is, in each case, formed as a projection, protruding from the rest of the focusing lens. Further still, at least one focusing lens may have a convexity, which is oriented for deflecting a portion of the light emitted from the light source, such that it passed by the aperture shutter on a second side of the aperture shutter, and is distributed by the secondary lens in a second beam path in a region lying on a second side of the light/dark border in the second light distribution, wherein this convexity lies to the left or right of a plane spanning the optical axis of the secondary lens and a vertical axis. This facilitates the generation of an overhead light distribution having a sufficient width.

Other objects, features and advantages of the present invention will be readily appreciated as the same becomes better understood after reading the subsequent description taken in connection with the accompanying drawings.

BRIEF DESCRIPTION OF THE DRAWINGS

Shown are, in each case in a schematic form.

DETAILED DESCRIPTION OF THE INVENTION

Figure 1:
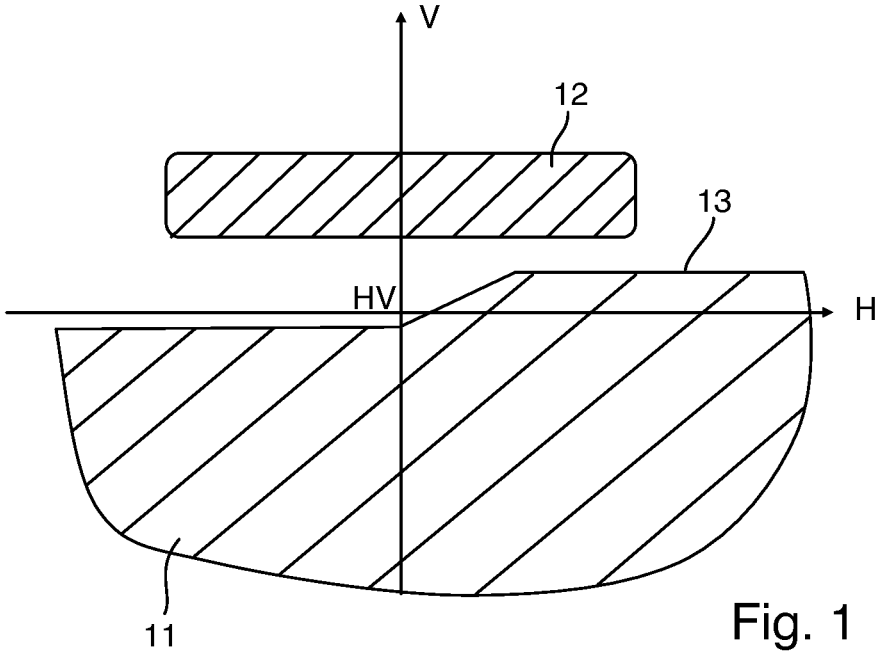
FIG. 1 shows a light distribution generated by a light module according to the invention, having a low beam light portion and an overhead light portion.

Referring now to the figures, where like numerals are used to designate like structure, FIG. 1 shows in detail a light distribution generated by a light module of the present invention on a measurement screen, wherein the measurement screen is located at a distance of numerous meters from the headlamp. A light distribution of this type is obtained with an intended use of the light module in a motor vehicle headlamp in a motor vehicle. The line H corresponds to the height of the horizon in front of the vehicle standing on a flat surface. The line V divides the foreground of the vehicle in a right and left half space. The intersection HV indicates a zero point on both lines, starting from which deviations are defined in angular degrees. The region 11 represents a light distribution conforming to the regulations for right hand traffic. The region 11, indicated by cross-hatching with large spacing, is illuminated brightly and is bordered at the top by a light/dark border 13. This low beam light portion serves to illuminate the street in front of the vehicle as well as the regions to the left and right of the street. The height of light/dark border is asymmetrical in order to avoid blinding oncoming traffic on the left side and so as to obtain the greatest possible range on the right hand side of the driving pathway.

The region 12, indicated by cross-hatching with smaller spacing and above the light/dark border, represents the so-called "overhead" region. This region is illuminated less brightly than the region 11, but is brighter than the area surrounding regions 11 and 12. In the regulations of the Economic Commission for Europe, ECE R112, ECE R123, or according to SAE PMVSS108, the overhead region is the region from −8° to +8° in the horizontal direction and from +2° to +4° in the vertical direction. In this region, only limited light intensities, in the range of 64-625 cd, are required and admissible, such that light modules conforming to the regulations direct only a small portion of the lighting current from the light module in this region. The light in this region is primarily needed for the identification of traffic signs. Because these signs have a high reflection coefficient and are high contrast, only a small amount of light is necessary identify them. As a result, blinding of oncoming traffic can be minimized with limited light intensities in this region while enabling the identification of important objects.

Figure 2:
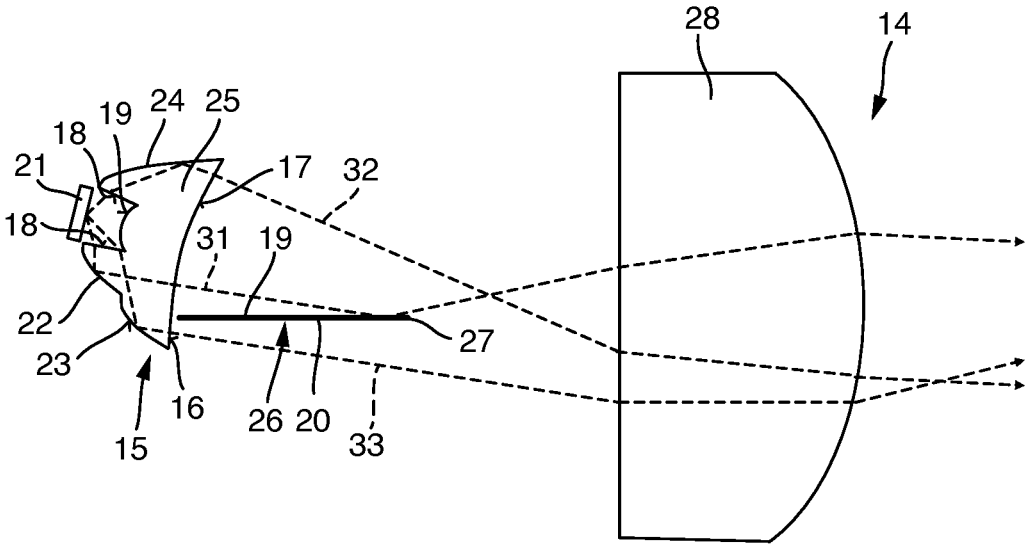
FIG. 2 shows a side view of an embodiment example of a light module according to the invention, having beam paths of the low beam light portion and the overhead light portion.

FIG. 2 shows a side view of an embodiment example of a light module 14 according to the invention, having beam paths 31, 32 of the low beam light portion and a beam path 33 of the overhead light portion. The light module 14 has a light source 21, a focusing lens 25, an aperture shutter 26, and a secondary lens 28 as the design for a secondary optical element. The light source 21 may be a semiconductor light source mounted on a mounting structure or a printed circuit board, in particular, a light emitting diode. This applies to all of the light sources specified in this application. The focusing lens 25 represents a design for a primary lens, which is configured (with its alignment and it optical properties) to transmit light emitted from the light source 21 to an intermediate light distribution lying between the primary lens and the secondary lens, which is concentrated into a small spatial region. The primary lens collects and bundles the light emitted from the light source for this purpose. The aperture shutter 26 has an aperture shutter surface, which extends into the intermediate light distribution and is bordered by an aperture shutter edge 27. The aperture shutter 26 is disposed in relation to the secondary lens 28 such that the aperture shutter edge 27 is projected by the secondary lens 28 as a light/dark border 13 in a second light distribution, which is generated in the foreground of the light module 18 by the secondary lens 28 as an image of the intermediate light distribution. The second light distribution is, for example, the light distribution 11 depicted in FIG. 1. The primary lens 25 is disposed in relation to the secondary lens 28 such that the secondary lens 28 distributes light from the intermediate light distribution, which passes by the aperture shutter on a first side of the aperture shutter 26, into a first beam path 31, 32 in a region lying on a first side of the light/dark border in the second light distribution. In FIG. 2, the first side of the aperture shutter is the side facing the half space above the aperture shutter.

The first beam path includes all of the light from the light source that is directed from the primary lens past the aperture shutter, on this first side of the aperture shutter, toward the secondary lens. The sub-beam path 32 includes the portion of the light from the light source captured by the primary lens thereby, that is directed by the primary lens without contacting the aperture shutter on the first side of the aperture shutter, and that is directed past the aperture shutter to the secondary lens. The sub-beam path 31 includes the portion of the light from the light source captured by the primary lens thereby, that is directed by the primary lens via a reflection occurring on the first side of the aperture shutter, passing by the aperture shutter to the secondary lens. The first side of the aperture shutter 26, implemented here as the upper surface, may be implemented as a reflecting surface, which can be obtained using a metallic coating. Specifically, this applies to the part of the first side 19 facing the aperture shutter edge 27, because the light intensity of the light striking the first side in the proximity of the aperture shutter edge 27 is comparatively at the greatest intensity. This is because the primary lens focuses the light in this region. In light modules known in the art, when a low beam light distribution is to be generated, the beam paths only pass by the aperture shutter on the first side of the aperture shutter, with or without reflection on the first side (upper surface).

The primary lens and the secondary lens are disposed in spaced relation to one another, corresponding to the sum of a secondary side image distance of the primary lens and a primary side focal length of the secondary lens. The aperture shutter edge 27 may be located in the light path at a spacing behind the primary lens corresponding to the secondary side image distance of the primary lens, and at a spacing to the secondary lens corresponding to the primary side focal length of the secondary lens. In FIG. 2, the first side of the aperture shutter 26 is its surface facing upward. The region lying on a first side of the light/dark border of the second light distribution is the bright region 11 lying beneath the light/dark border (for example, the low beam light distribution). With the specified spacings and focal lengths, the secondary lens 28 forms the intermediate light distribution, such that it is inverted and reflected over a vertical axis (right/left reversed).

A light module, such as that depicted in FIG. 2, is also referred to as a projection module. In general, projection modules project an intermediate light distribution using a secondary lens (usually an imaging lens), which is generated with one or more light sources having an appropriate primary lens (such as a reflector or focusing lens) in an intermediate imaging plane lying in the focal point of the secondary lens. An aperture shutter edge, which is disposed in the intermediate imaging plane, is usually used for generating a light/dark border. Light modules known in the art have primary lenses and aperture shutter assemblies, which only allow the light to pass above the aperture shutter. Thus, the low beam light distribution 11 depicted in FIG. 1 can be generated. However, no light can be deflected to the overhead region 12 of FIG. 1. The present invention is distinguished in that the primary lens is configured for deflecting a portion of the light emitted from the light source 21 such that it passes by the aperture shutter on a second side 20 of the aperture shutter 26, and is distributed by the secondary lens 28 in a second beam path 33 in a region lying on a second side of the light/dark border in the second light distribution. The second beam path includes all light from the light source that is directed by the primary lens to the secondary lens, passing by this side of the aperture shutter. The secondary lens directs at least a portion of this light into the overhead region.

Figure 6:
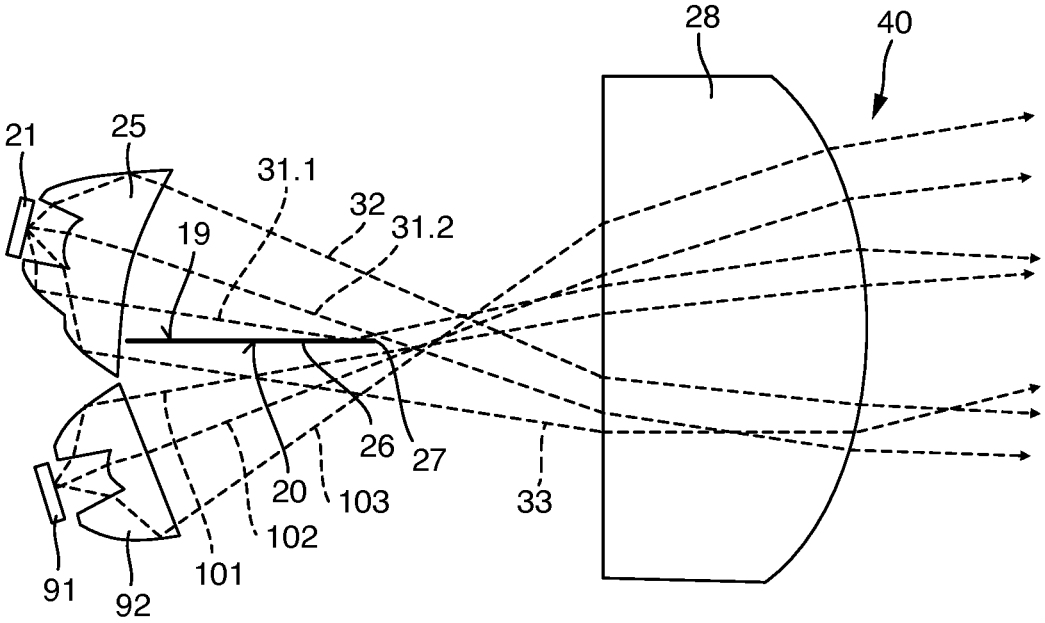
FIG. 6 shows a side view of another embodiment example of a light module according to the invention, having beam paths for the low beam light portion, the overhead light portion and an additional portion, serving to generate a high beam light distribution.

In FIG. 2, the second side 20 of the aperture shutter 26 is its downward facing side. The region of the second light distribution lying on a second side of the light/dark border is the bright region 12 lying above the light/dark border in FIG. 1 (for example, the overhead light distribution). Here as well, that the secondary lens 28 projects the intermediate light distribution such that it is inverted and reflected over a vertical axis (right/left reversed), also applies. With respect to the configuration of the aperture shutter and the primary light sources, each of which is formed by a light source and a focusing lens allocated thereto, the main beam direction of the primary light sources may be directed, in each case, toward the aperture shutter edge. In doing so, the main beam direction of the primary light sources is not parallel to the optical axis of the secondary lens. The primary light sources for the low beam light function are disposed above the horizontal aperture shutter surface. With a light module also configured for generating a high beam light distribution, as shown in FIG. 6, the high beam primary light sources are disposed beneath the horizontal aperture shutter surface. The light bundle generated by the lateral surfaces of the convexity runs nearly parallel to the aperture shutter surface, such that at least a partial light bundle is obtained from the overhead light bundle that runs parallel to the aperture shutter surface.

The primary lens, or focusing lens 25, in FIG. 2 is essentially a hybrid of an internal total reflection reflector and a lens. The focusing lens has a light entry surface exhibiting numerous sub-surfaces 18, 19, a light exit surface 17, and light deflecting lateral surfaces 24, 22, and includes a transparent material such as glass, PC, or PMMA. The light entry surface 17 has a central part and peripheral parts bordering the central part. The light source 21 and the different parts 18, 19 of the light entry surface are disposed in relation to one another such that the greatest possible portion of the light emitted from the light source 21 strikes the light entry surface at such a steep angle that this light is not reflected there, but rather enters the focusing lens 25 at the part that reflects light at a total reflection. Thus, upon passing through the focusing lens 25, the light experiences different changes in direction, which are caused by refraction or reflection. As such, the light propagated in the beam paths 31 and 32, for example, the path of which runs along the aperture shutter on the first side of the aperture shutter (above it, in this case) experiences a refraction at the light entry, which occurs via a peripheral part 18 of the light entry surface, an internal total reflection at a lateral surface 24, and a refraction at the light exit, via the light exit surface 17. The internal total reflection is the same with the focusing lens as with an optical fiber. In differing from an optical fiber, only very little reflection occurs in a beam path in the focusing lens, advantageously only an internal total reflection, while a beam path running through an optical fiber is normally subjected to many more reflections. Furthermore, there is light that enters via the central part 19 or a peripheral part 18 of the light entry surface, in the light refracting part of the focusing lens 25, and passes, without reflection on a lateral wall, directly to the light exit surface 17. This light is therefore refracted twice during the passage through a conventional lens.

As mentioned above, a light module of the present invention is distinguished by a primary lens, which is configured to deflect a portion of the light emitted from the light source such that it passes by the aperture shutter on a second side of the aperture shutter, and is distributed by the secondary lens in a second beam path in a region lying on a second side of the light/dark border in the second light distribution. For this purpose, the focusing lens depicted in FIG. 2 has a convexity 15 on its lateral surface 22. The convexity 15 lies thereby on a part of the lateral surface of the focusing lens that faces the same side as the second side 20 of the aperture shutter 26. The convexity 15 may be formed as a single piece together with the rest of the focusing lens, and protrudes as a projection from the lateral surface 22 of the rest of the focusing lens, and is bordered by a convexity lateral surface 23 and a convexity light exit surface 16. In FIG. 2, the convexity 2 is the part of the focusing lens running below the dotted line.

In the design depicted in FIG. 2, the part of the lateral surface of the focusing lens 25, which faces the same side as the second side 20 of the aperture shutter 26, has a sub-surface 22, in addition to the convex lateral surface 23, that is complementary to the convex lateral surface 23, which reflect light striking it such that this light is propagated in the first beam path. In FIG. 2, this same side is the lower side. The convexity 15 furthermore lies in a part of the lateral surface that is closer to the light exit surface 17 of the primary lens than to the light entry surface. The convexity 15 has a light exit surface 16. The light exit surface 16 may border the rest of the light exit surface 17 of the convexity 15. The transition from the light exit surface 16 to the rest of the light exit surface 17 may occur without a crease, making it consistently distinguishable. The angle of incidence for the light from the light source striking the convexity is defined with the solid angle, at which the convexity 15, and in particular its deflecting lateral surface 23 and its light exit surface 16 appears, viewed from the light source.

The convexity is advantageously disposed such that it deflects the light striking at this solid angle toward the light exit surface 16 and/or 17 such that it passes by the second side of the aperture shutter 22, taking into account the refraction occurring at the light exit surface 16 and/or 17, and is distributed by the secondary lens 28 in a second beam path 33 in the region lying on the second side of the light/dark border 13 in the second light distribution. In FIG. 1, this is the region 12 lying above the light/dark border. The convexity 15, and the part 16 of the light exit surface of the focusing lens that is lighted via this convexity 15, are furthermore designed such that the light is distributed in an angular region for an overhead lighting that conforms to the regulations. The specified solid angle, in which the convexity appears here, viewed from the perspective of the light source, may be large enough that the light propagated in it from the light source satisfies the light intensity demands for an overhead lighting conforming to the regulations. Due to the limited acceptable light intensity there, the light exit surface 16 of the convexity 23 is much smaller than the rest of the light exit surface 17 of the focusing lens 25, and with a primary lens including numerous focusing lenses, in particular, is even smaller than the light exit surfaces of the entire primary lens. This is because, advantageously, less than half of the focusing lenses of a primary lens having numerous focusing lenses are provided with a convexity of this type.

FIG. 2 shows an embodiment of a projection light module according to the invention, which can deflect a sufficient amount of light into the overhead region 12. The light source 21 emits light, which is bundled via the focusing lens 25. The focusing lens is configured such that the main portion of the light is deflected, with the complementary parts 22, 24, to the convex lateral surface 23 of the convexity 15, on the lateral surfaces of the focusing lens 25, into the region lying above the preferably horizontal aperture shutter 26, while a smaller portion of the light is deflected by the convexity 15 into the region lying beneath the aperture shutter 26.

The main portion of the light is represented in FIG. 1 by the beam paths 31 and 32, while the smaller portion of the light from the light source 21 is represented by the beam path 33. The aperture shutter edge 27 masks a portion of the light in an intermediate image plane. The intermediate image plane lies in the proximity of the focal point of the secondary lens 28. The secondary lens 28 projects the light distribution in the intermediate image plane into the surroundings. The beams that are deflected over the aperture shutter are focused by the secondary lens into the low beam light region 11. The aperture shutter edge generates the light/dark border 13. The surface 23 is configured such that the beams that are deflected beneath the aperture shutter are projected by the secondary lens into the overhead region 12.

Figure 3:
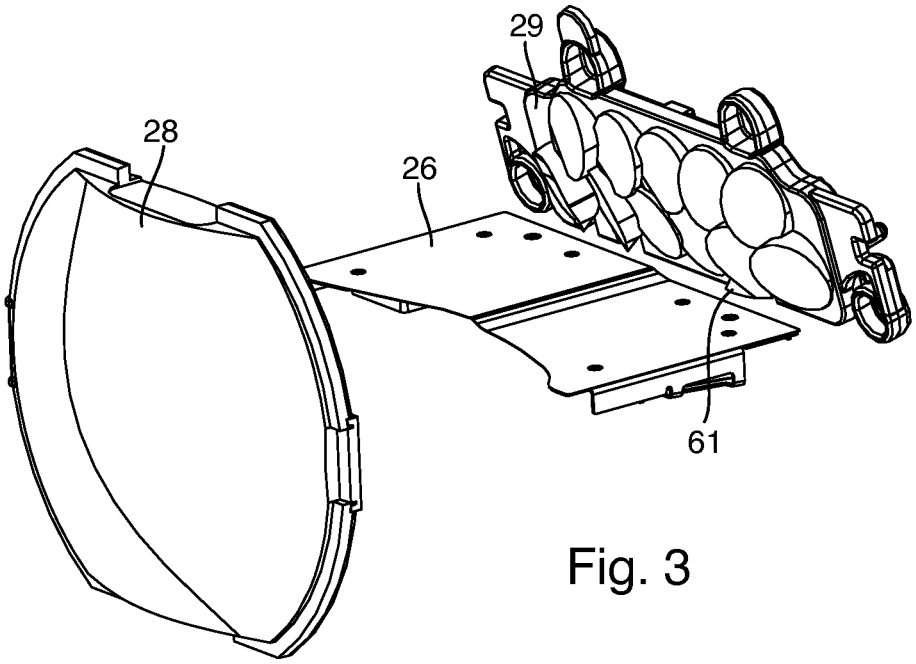
FIG. 3 shows a perspective illustration of some components of an embodiment example of a light module according to the invention.

FIG. 3 shows a perspective illustration of some components of an embodiment example of a light module according to the invention. Specifically, FIG. 3 shows an implementation of a light module having a complex light source, which exhibits n=11 optical fiber light sources and a primary lens 29, which is composed of n=11 individual focusing lenses. The light from a light source, in each case, is coupled thereby in exactly one focusing lens structurally allocated to this light source. The light sources lie behind the plane of the illustration in the depiction selected for FIG. 3, and are therefore hidden behind the focusing lenses of the primary lens. The configuration of the light sources and the associated focusing lenses corresponds to the configuration explained in reference to FIG. 2, wherein, however, only some of the focusing lenses in FIG. 3 exhibit the convexity depicted in the figure. Of the eleven individual focusing lenses in FIG. 3, two of the focusing lenses have an additional surface 61, each of which corresponds to the light exit surfaces 16 of the convexity 23 explained in conjunction with FIG. 2, and serves to deflect light into the overhead region. Because the convexities are each implemented as projections protruding from the rest of the focusing lens, the light exit surfaces 16, 61 represent additional surfaces, which enlarge the light exit surfaces 17 of the respective rest of the focusing lens, present without such convexities 23. Light exits at these additional light exit surfaces 61 that is deflected beneath the aperture shutter 26, and in this way, lights the overhead region 12, as explained previously in reference to FIG. 1. Those having ordinary skill in the art will understand that n does not have to equal 11, and that n, in particular, that n is dependent on the size of the light current from an individual light source. The larger the light current of an individual light source is, the smaller n can be.

FIG. 3 also shows that the configuration of the n light sources and their n focusing lenses occurs on a mounting structure, which has fastening components, in this case, clips provided with holes. The mounting structure, together with the light sources and their focusing lenses, forms a structural component that can be preassembled, which can also be referred to as a complex light source. This complex light source is a low beam light complex light source in the subject matter of FIGS. 3 and 4. The complex light source can be attached to frame structures of the light module and/or an aperture shutter assembly and/or a secondary lens assembly, with the fastening components, such that a defined configuration of these components in relation to one another is obtained.

Figure 4:
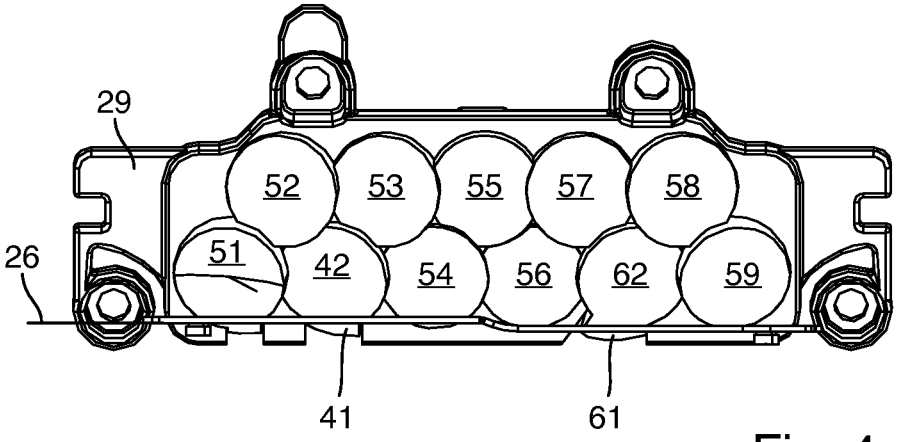
FIG. 4 shows a view of a front side of a configuration of primary lenses of the embodiment example from FIG. 3, which emits light.

FIG. 4 shows a view of a light emitting front side of a configuration of focusing lenses in the embodiment example from FIG. 3. FIG. 4 shows in detail the focusing lens 29 with the light exit surfaces 42, 51, 52, 53, 54, 55, 56, 57, 58, 59, 62 of the 11 individual focusing lenses. The light exit surfaces 42 and 62 of two focusing lenses are designed such that they have additional surfaces 41 and 61, which are light exit surfaces of convexities 23, and with which light is deflected beneath the aperture shutter 26. It is to be understood that it is also possible for more than two, or only one, focusing lens to have a convexity 23. This also depends on the solid angle, taken by a single convexity from the low beam light of the light sources, and deflected into the overhead region. Designs having two or more convexities, however, are advantageous, of which at least one is disposed to the right, and at least one is disposed to the left of a central focusing lens. For this, a focusing lens is understood to be a focusing lens which, in an intended use of the light module, is cut by a plane which spans the optical axis of the secondary lens and a vertical axis. This facilitates a homogenous lighting of the overhead region because the region is wider in the horizontal direction than in the vertical direction. Furthermore, the off-center configuration of two convexities, with which the overhead light bundle is extracted from the part of the light bundle from the light source with which the center of the light distribution is illuminated. This is advantageous because a light intensity maximum is desired in the middle of the low beam light distribution.

In one embodiment, at least one focusing lens has a convexity which is configured to deflect a portion of the light emitted from the light source, such that it passes by the aperture shutter on a second side of the aperture shutter and is distributed by the secondary lens in a second beam path in a region lying on a second side of the light/dark border in the second light distribution, wherein this convexity lies either to the right or left of a plane which spans the optical axis of the secondary lens and a vertical axis. The additional surfaces 41 and 61 correspond to the light exit surface 16 explained in conjunction with FIG. 2. As shown in the front view, as well as in FIG. 2, the additional sub-surfaces of the respective light exit surfaces of the focusing lenses lie below the aperture shutter 26, while the rest of the light exit surfaces 51-59 lie above the aperture shutter 26. Due to the proportions of the surfaces 41, 61 in relation to the other light exit surfaces, the major portion of the light is deflected into the region above the aperture shutter. For this, it can be assumed that the respective portion of light is approximately proportional to the respective light exit surface.

Figure 5:
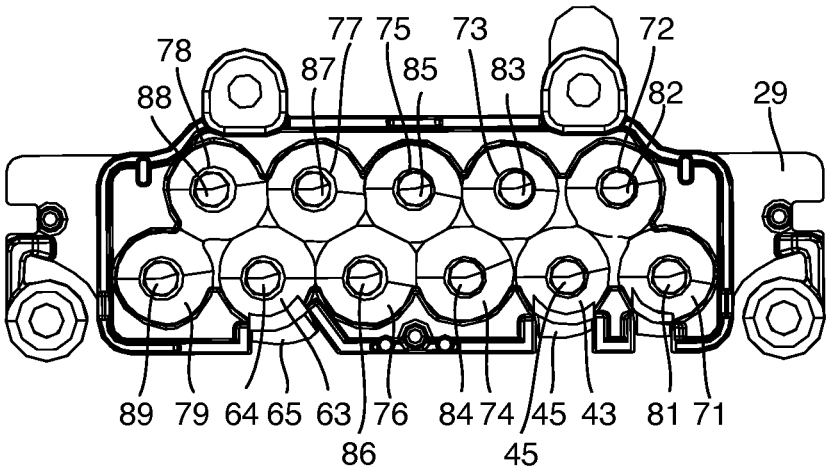
FIG. 5 shows a view of a back surface of the configuration of primary lenses and aperture shutters of the embodiment example in FIG. 3, configured for bundling light.

FIG. 5 shows a view of a back surface of the assembly of focusing lenses from the embodiment example in FIG. 3, configured for coupling light. The back surface is, in this case, also the side where light is coupled in the focusing lenses. The n=11 LEDs project light from this side into the n=11 individual focusing lenses. The central parts 81, 82, 83, 84, 85, 86, 87, 88, 89, 45, 64 of the light entry surfaces of the individual focusing lenses that focus directly, the lateral surfaces 71, 72, 73, 74, 75, 76, 77, 78, 79, 43, 63 of the parts of the focusing lenses that do not focus directly, at which internal total reflections occur, and, furthermore, reflecting surfaces 45, 65, which deflect light in a controlled manner below the aperture shutter, and thus correspond to the internal total reflecting border surfaces of the convexity 23 from FIG. 2, are visible. The part that focuses directly thus corresponds to the part functioning as a lens in the focusing lens. The part that focuses indirectly corresponds to the part of the focusing lens, on the border surface of which internal total reflection occurs in addition thereto. The described solution for the light module with which both a low beam light distribution and a high beam light distribution can be generated is particularly advantageous.

FIG. 6 shows a side view of a light module 40 of this type as another embodiment example of a light module according to the invention. FIG. 6 shows, in particular, beam paths 31, 32.1, 32.2 of the low beam light portion, a beam path 33 of the overhead light portion, and beam paths 101, 102, 103 of an additional portion, for generating a high beam light distribution. For this, the high beam light portion is generated by, in comparison with the subject matter of FIG. 2, additional light sources 91 and focusing lenses 92. The light sources 91 may also be semiconductor light sources, in particular, light emitting diodes. The focusing lenses 92 may likewise be transparent solid bodies having a central part functioning as a lens, and lateral surfaces, at which bundling internal total reflections occur. The light entry surface may likewise be divided into a central part and peripheral parts, as has been explained in relation to the subject matter of FIG. 2. In differing from the subject matter of FIG. 2, the focusing lenses 92 participating in the generation of the high beam light distribution, lying above the light/dark border of the second light distribution, however, have no convexities deflecting light to another side of the aperture shutter 26, because this occurs with the rest of the respective focusing lens. The focusing lens 92 deflects all of the coupled light from its structurally allocated light source 91 past the second side 20 of the aperture shutter 26. This is indicated by the beam paths 101, 102, and 103. In FIG. 6, the second side is the lower side of the aperture shutter, which also corresponds to the configuration in an intended use of the light module. As can be derived from the directions of these beam paths after they have been deflected by the secondary lens 28, this light illuminates regions lying above the light/dark border in FIG. 1. The intensity of the light propagated in these beam paths is substantially greater that the intensity of the overhead light propagated in the beam path 33, such that the brightness resulting from the overhead light is entirely outshined by the brightness generated by the light sources 91.

Figure 7:
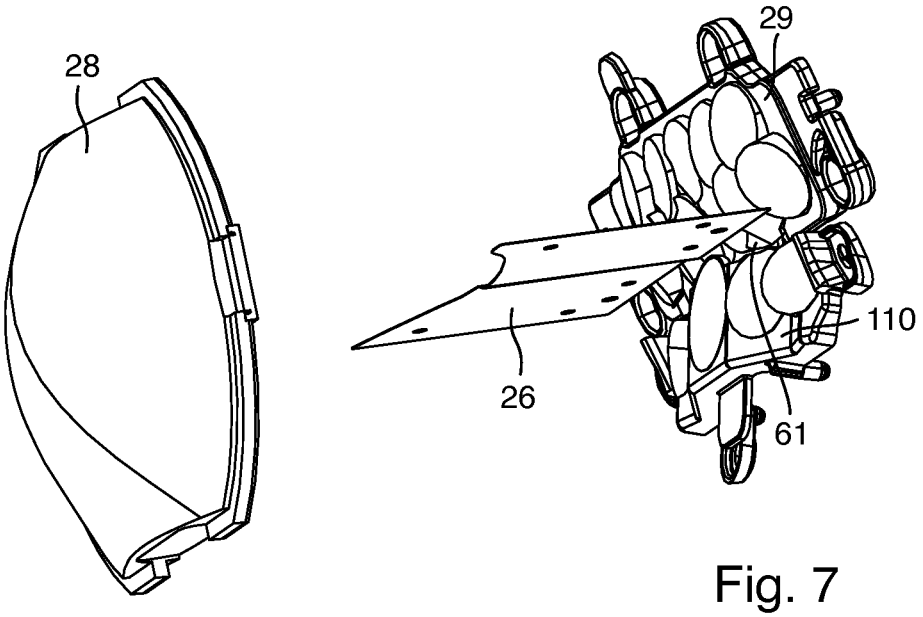
FIG. 7 shows a perspective view of some components of a light module configured for generating a low beam light portion, an overhead light portion, and a high beam light portion.

FIG. 7 shows a perspective view of some components of a light module configured to generate a low beam light portion, an overhead light portion, and a high beam light portion. The light module of FIG. 7 is based on the light module in FIG. 3 and similarly has a low beam light complex light source, an aperture shutter, and a secondary lens in the form of a projection lens. To this extent, the explanations of FIG. 3 also apply to the subject matter in FIG. 7. Furthermore, the subject matter in FIG. 7 also has an additional structural assembly, which serves as a complex light source 110 for an additional light distribution. The additional light distribution lies above the horizon and supplements thereby the low beam light distribution lying substantially below the horizon, to form a high beam light distribution. The complex light source 110 has m=5 light sources and m=5 of these light sources each has one specifically allocated focusing lens, each of which couples the light of exactly one light source.

It is to be understood here that the number of pairs of light sources and focusing lenses is dependent, for example, on the light intensity of the light sources, and therefore can also be greater than or less than five. The complex light source 110 has fastening structures, as is also the case with the complex light source of FIG. 3. These may be formed, as is also the case with the fastening structures for the subject matter in FIG. 3, such that the two complex light sources can be connected to form a coherent and rigid structural assembly, such that an adjustment of the beam directions and a setting in the headlamp can occur collectively. With the fastening elements, the complex light source can be attached to frame structures of the light module, and/or an aperture shutter assembly and/or a secondary lens assembly, such that a defined configuration of these components in relation to one another is obtained. The modular construction furthermore enables a cost-effective production, because, for example, for light modules that only have to generate a low beam light distribution (and an overhead light distribution, but not a high beam light distribution), and for light modules that are also supposed to generate a high beam light distribution, the same structural assemblies, in the form of the low beam light complex light source, the aperture shutter assembly, and the secondary lens, can be used.

Figure 8:
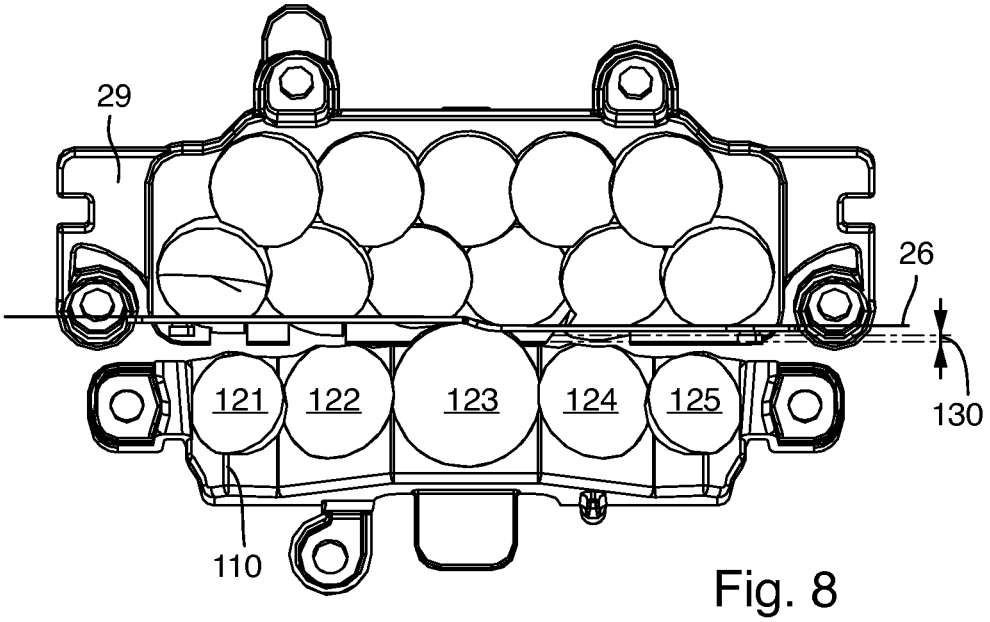
FIG. 8 shows a view of a front side of a light emitting configuration of primary lenses of the embodiment example in FIG. 7.

FIG. 8 shows a view of a light emitting front side of a configuration of primary lenses for the embodiment example in FIG. 7. As explained above, in reference to the prior art, it is disadvantageous for a light module to generate a high beam light distribution in addition to a low beam light distribution, if the overhead light is to be generated with an additional aperture shutter between the aperture shutter and secondary lens. The disadvantage results from the fact that an additional aperture shutter of this type would at least partially block the light path for the high beam. The embodiment example of a light module according to the invention illustrated in the FIGS. 6-8 is distinguished, in contrast, in that at the points where the low beam light focusing lens 29 deflects light beneath the aperture shutter 26 with the aid of the surfaces 41 and 61 (for example, with the aid of the light exit surfaces from convexities on the focusing lens), the lower edge of the low beam focusing lens and the upper edge of the high beam focusing lens have a sufficient spacing 130 to one another, as is illustrated in FIG. 8. In the design depicted there, these conditions are fulfilled in that the focusing lenses 122, 123 of the high beam assembly, which are disposed beneath the focusing lenses of the low beam assembly, having additional convexities 23, are smaller than a central focusing lens of the high beam assembly, which lies between the focusing lenses 122, 123 of the high beam assembly.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A light module for a motor vehicle headlamp having at least one first light source, one primary lens, one aperture shutter, and one secondary lens, wherein the primary lens is configured to transmit light emitted from the light source to an intermediate light distribution lying between the primary lens and the secondary lens, wherein the aperture shutter has a coherent outer edge and a shuttering surface, which extends into the intermediate light distribution, and is bordered by an aperture shutter edge, and wherein the aperture shutter is disposed in relation to the secondary lens such that the aperture shutter edge is projected as a light/dark border by the secondary lens in a second light distribution, which is generated by the secondary lens in a foreground of the light module as an image of the intermediate light distribution, and wherein the primary lens is disposed in relation to the secondary lens such that the secondary lens distributes light from the intermediate light distribution, which passes by the aperture shutter on a first side of the aperture shutter, in a first beam path, in a region lying on a first side of the light/dark border in the second light distribution, wherein the primary lens is configured to deflect a portion of the light emitted from the light source such that it ends up on a second side of the aperture shutter, passing by the aperture shutter on the outside, and is distributed by the secondary lens in a second beam path in a region lying on a second side of the light/dark border in the second light distribution.

2. The light module as set forth in claim 1, wherein the light source is a semiconductor light source, in particular a light emitting diode, mounted on at least one of a mounting structure and a printed circuit board.

3. The light module as set forth in claim 1, wherein at least one side of the aperture shutter is implemented as a reflecting surface.

4. The light module as set forth in claim 1, wherein the primary lens has a light entry surface having numerous subsurfaces, a light exit surface, and light deflecting lateral surfaces.

5. The light module as set forth in claim 4, wherein the light entry surface has a central part and peripheral parts bordering on the central part, and in that the light source and the different parts of the light entry surface are disposed in relation to one another such that the light is subjected to different directional changes, caused by refraction and reflection, when passing through the focusing lens.

6. The light module as set forth in claim 1, wherein light, the path of which runs on the first side of the aperture shutter, experiences a refraction upon entry, which occurs via a peripheral part of the light entry surface, experiences an internal total reflection at a lateral surface, and experiences, upon exit, a refraction via the light exit surface.

7. The light module as set forth in claim 1, wherein the focusing lens is configured to allow light, which enters the focusing lens via the central part of the light entry surface, to pass directly to the light exit surface, without reflection on a lateral wall.

8. The light module as set forth in claim 1, wherein the primary lens has a convexity on its lateral surface, wherein the convexity lies on a part of the lateral surface of the focusing lens, which faces the same side as the second side of the aperture shutter.

9. The light module as set forth in claim 8, wherein the convexity is a single piece with the rest of the primary lens, and extends as a protrusion from the lateral surface of the rest of the primary lens, and is bordered by a convexity lateral surface and a convexity light exit surface.

10. The light module as set forth in claim 8, wherein the convexity lies in a portion of the lateral surface of the focusing lens, which is closer to the light exit surface of the primary lens than to the light entry surface.

11. The light module as set forth in claim 8, wherein the convexity has a light exit surface, which borders on the rest of the light exit surface of the convexity, wherein the transition from the light exit surface to the rest of the light exit surface is without a crease.

12. The light module as set forth in claim 11, wherein the convexity lateral surface and the convexity exit surface are disposed in relation to their alignment to the light from the light source striking the complexity lateral surface such that they direct at least a portion of this light to the secondary lens, along the aperture shutter, on the second side of the aperture shutter.

13. The light module as set forth in claim 11, wherein the convexity and its light exit surface, is designed such that the overhead region of the light distribution is illuminated by the light emitted from the light exit surface.

14. The light module as set forth in claim 11, wherein convexities are each implemented as protrusions from the rest of the focusing lens.

15. The light module as set forth in claim 1, wherein at least one focusing lens has a convexity, which is configured for deflecting a portion of the light emitted from the light source, such that it passes by the aperture shutter on a second side of the aperture shutter, and is distributed by the secondary lens in a second beam path in a region lying on a second side of the light/dark border in the second light distribution, wherein this convexity lies to the right or left of a plane spanning the optical axis of the secondary lens and a vertical axis.

* * * * *